US008635930B2

(12) United States Patent
Willemsen et al.

(10) Patent No.: US 8,635,930 B2
(45) Date of Patent: Jan. 28, 2014

(54) FLOOR MOUNTED PEDAL WITH POSITION SENSOR

(75) Inventors: Larry Willemsen, Morpeth (CA); Dan O'Neill, Chatham (CA)

(73) Assignee: KSR Technologies Co., Ridgetown (CA)

( * ) Notice: Subject to any disclaimer, the term of this patent is extended or adjusted under 35 U.S.C. 154(b) by 109 days.

(21) Appl. No.: 12/137,877

(22) Filed: Jun. 12, 2008

(65) Prior Publication Data

US 2008/0314192 A1 Dec. 25, 2008

Related U.S. Application Data

(60) Provisional application No. 60/945,753, filed on Jun. 22, 2007.

(51) Int. Cl.
*G05G 1/38* (2008.04)

(52) U.S. Cl.
USPC ..... 74/512; 74/514; 74/560

(58) Field of Classification Search
USPC ..... 74/512–514, 560
See application file for complete search history.

(56) References Cited

U.S. PATENT DOCUMENTS

| | | | | |
|---|---|---|---|---|
| 4,976,166 | A | 12/1990 | Davis et al. | |
| 5,063,811 | A * | 11/1991 | Smith et al. | 74/513 |
| 5,133,225 | A | 7/1992 | Lundberg et al. | |
| 5,415,144 | A | 5/1995 | Hardin et al. | |
| 5,497,677 | A * | 3/1996 | Baumann et al. | 74/513 |
| 5,507,201 | A | 4/1996 | Fairbairn et al. | |
| 5,761,967 | A * | 6/1998 | Papenhagen et al. | 74/513 |
| 6,289,762 | B1 * | 9/2001 | Silva | 74/513 |
| 6,426,619 | B1 | 7/2002 | Pfaffenberger et al. | |
| 6,480,805 | B1 | 11/2002 | Irle et al. | |
| 6,515,473 | B2 | 2/2003 | Pfaffenberger et al. | |
| 6,593,730 | B2 | 7/2003 | Zapf et al. | |
| 6,626,061 | B2 * | 9/2003 | Sakamoto et al. | 74/512 |
| 6,985,018 | B2 | 1/2006 | Madni et al. | |
| 7,188,592 | B2 | 3/2007 | Baldi et al. | |
| 7,631,574 | B2 * | 12/2009 | Leone | 74/513 |
| 2005/0097980 | A1 * | 5/2005 | Menzies | 74/512 |
| 2007/0103148 | A1 | 5/2007 | Iezzi | |
| 2007/0151398 | A1 * | 7/2007 | Kim et al. | 74/513 |
| 2007/0157755 | A1 * | 7/2007 | Kim et al. | 74/513 |
| 2007/0193401 | A1 * | 8/2007 | Campbell | 74/560 |
| 2007/0289402 | A1 * | 12/2007 | La et al. | 74/513 |

* cited by examiner

*Primary Examiner* — Thomas Diaz
(74) *Attorney, Agent, or Firm* — Gifford, Krass, Sprinkle, Anderson & Citkowski, P.C.; Thomas E. Anderson

(57) ABSTRACT

An electronically controlled floor mounted pedal assembly with a position sensor includes a base. A control arm is pivotally mounted to the base member at a control arm pivot axis, and a pedal arm is pivotally mounted to the base member at a pedal arm pivot axis. The control arm free end is positioned adjacent an inner surface of the pedal arm. A friction generating member mounted on the control arm free end contacts a pedal arm friction member positioned on the inner surface of the pedal arm to generate frictional hysteresis force. A spring positioned between the base member and the control arm free end initially biases the control arm against the pedal arm. A position sensor supported on the base member about the control arm pivot axis senses angular rotation of the control arm about the control arm pivot axis as the pedal arm rotates about the pedal arm pivot axis.

20 Claims, 6 Drawing Sheets

| Pedal Pad | Pedal Lever Arm |
|---|---|
| 1 | 1.351 |
| 2 | 2.702 |
| 3 | 4.053 |
| 4 | 5.404 |
| 5 | 6.755 |
| 6 | 8.106 |
| 7 | 9.457 |
| 8 | 10.808 |
| 9 | 12.159 |
| 10 | 13.51 |
| 11 | 14.861 |
| 12 | 16.212 |
| 13 | 17.563 |
| 14 | 18.914 |
| 15 | 20.265 |
| 16 | 21.616 |
| 16.05 | 21.684 |

FLOOR MOUNTED PEDAL WITH POSITION SENSOR

CROSS-REFERENCE TO RELATED APPLICATIONS

This application claims priority of United States Provisional Patent Application Ser. No. 60/945,753 filed Jun. 22, 2007, which is incorporated herein by reference.

BACKGROUND OF THE INVENTION

1. Field of the Invention

The present invention relates generally to electronic controls for vehicles, and more particularly, to an electronically controlled floor mounted pedal with a position sensor.

2. Description of the Related Art

Vehicles, and in particular automotive vehicles, utilize a foot-operated device, such as a brake pedal or a throttle control pedal, also referred to as an accelerator pedal, to control the movement of the vehicle. Conventional brake systems include a brake pedal for transmitting a braking force from the vehicle operator to the wheels of the vehicle. Similarly, conventional throttle control systems include a throttle pedal to transmit a signal from the vehicle operator to a controller to control acceleration and movement of the vehicle. The pedal may be attached to a portion of the vehicle, such as mounted on the floor or suspended from a wall.

Recent innovations in electronics technology have led to increased use of electronic controls for vehicle systems, such as the throttle system or the brake system. In an electronically controlled throttle control system, the movement of the pedal is determined by a position sensor, which senses the relative position of the pedal arm and transmits a signal to a controller to operate the throttle. The electronically controlled brake system operates in a similar manner.

While presently available floor mounted pedals work, they are bulky parts and may be expensive to manufacture. Thus, there is a need in the art for a cost-effective electronically controlled floor mounted pedal that includes a position sensor.

SUMMARY OF THE INVENTION

Accordingly, an electronically controlled floor mounted pedal with a position sensor is provided. The pedal assembly includes a base member fixedly attached to the vehicle and having a lower portion and an upper portion. A control arm includes a first free end and a second end that is pivotally mounted to the base member at a control arm pivot axis. A pedal arm is pivotally mounted to the base member at a pedal arm pivot axis, and the pedal arm includes an inner surface, and the control arm second, free end is positioned adjacent the inner surface of the pedal arm. A friction generating member is mounted on the control arm free end. The control arm friction generating member contacts a pedal arm friction member positioned on the inner surface of the pedal arm to generate frictional hysteresis force that is translated back through the pedal arm as the pedal arm is depressed. A spring is positioned between the base member and the control arm free end. The spring initially biases the control arm against the pedal arm. A position sensor is supported on the base member about the control arm pivot axis. The position sensor is operatively connected to the control arm to sense angular rotation of the control arm above the control arm pivot axis due to rotation of the pedal arm about the pedal arm pivot axis and transmits this sensed angular rotation to a controller.

One advantage of the present invention is that an electronically controlled floor mounted pedal assembly is provided that includes a position sensor. Another advantage of the present invention is that the electronically controlled floor mounted pedal is simpler in design than previous attempts, to enhance packageability within the interior environment of the vehicle. Still another advantage of the present invention is that the electronically controlled floor mounted pedal assembly is cost effective to manufacture. A further advantage of the present invention is that the electronically controlled floor mounted pedal utilizes a rotary position sensor to accurately sense pedal position.

Other features and advantages of the present invention will be readily appreciated, as the same becomes better understood after reading the subsequent description taken in conjunction with the accompanying drawings.

DETAILED DESCRIPTION OF THE INVENTION

Figure 1:
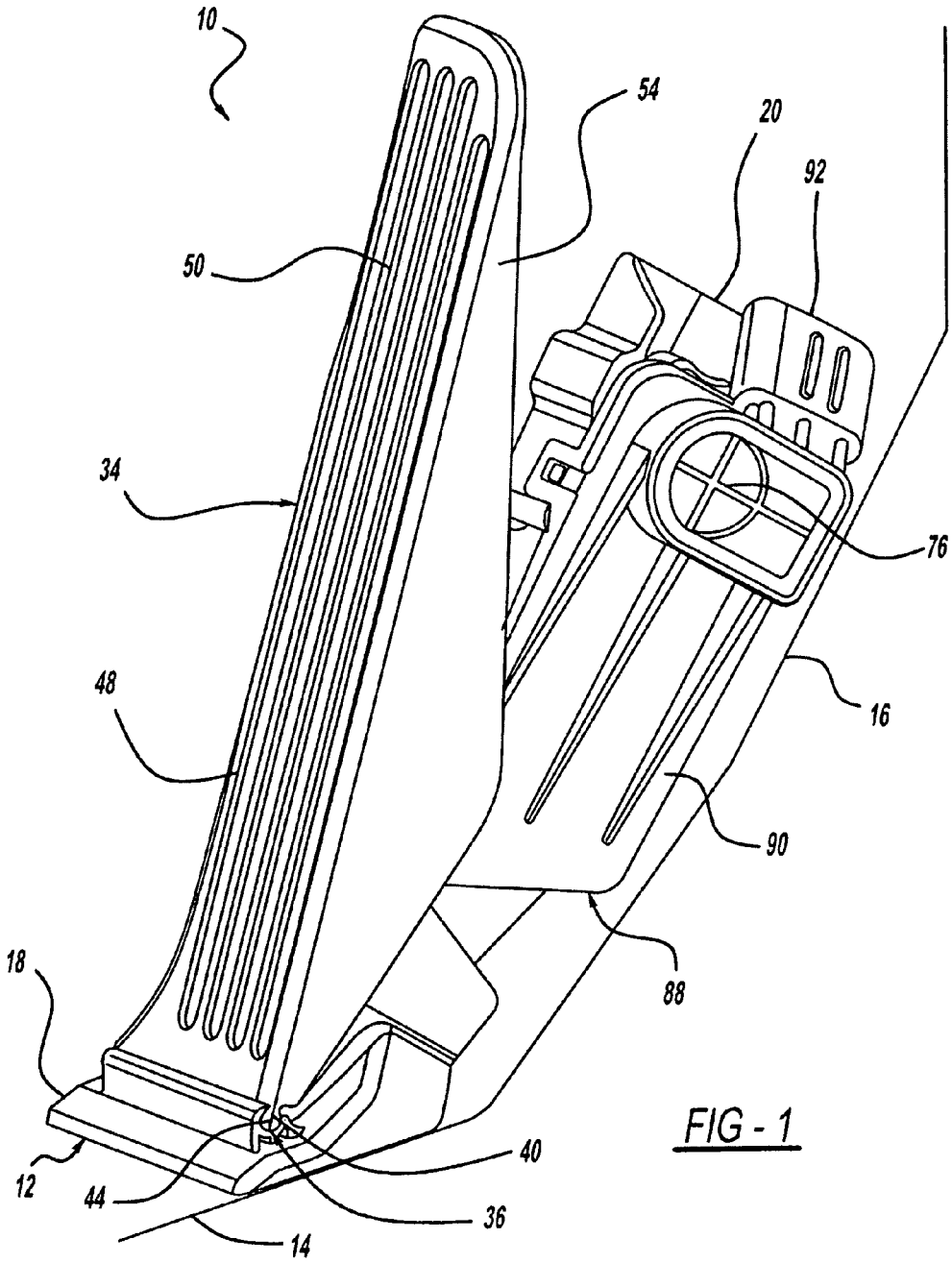
FIG. 1 is a perspective side view of an electronically controlled floor mounted pedal assembly, according to the present invention.
Figure 2:
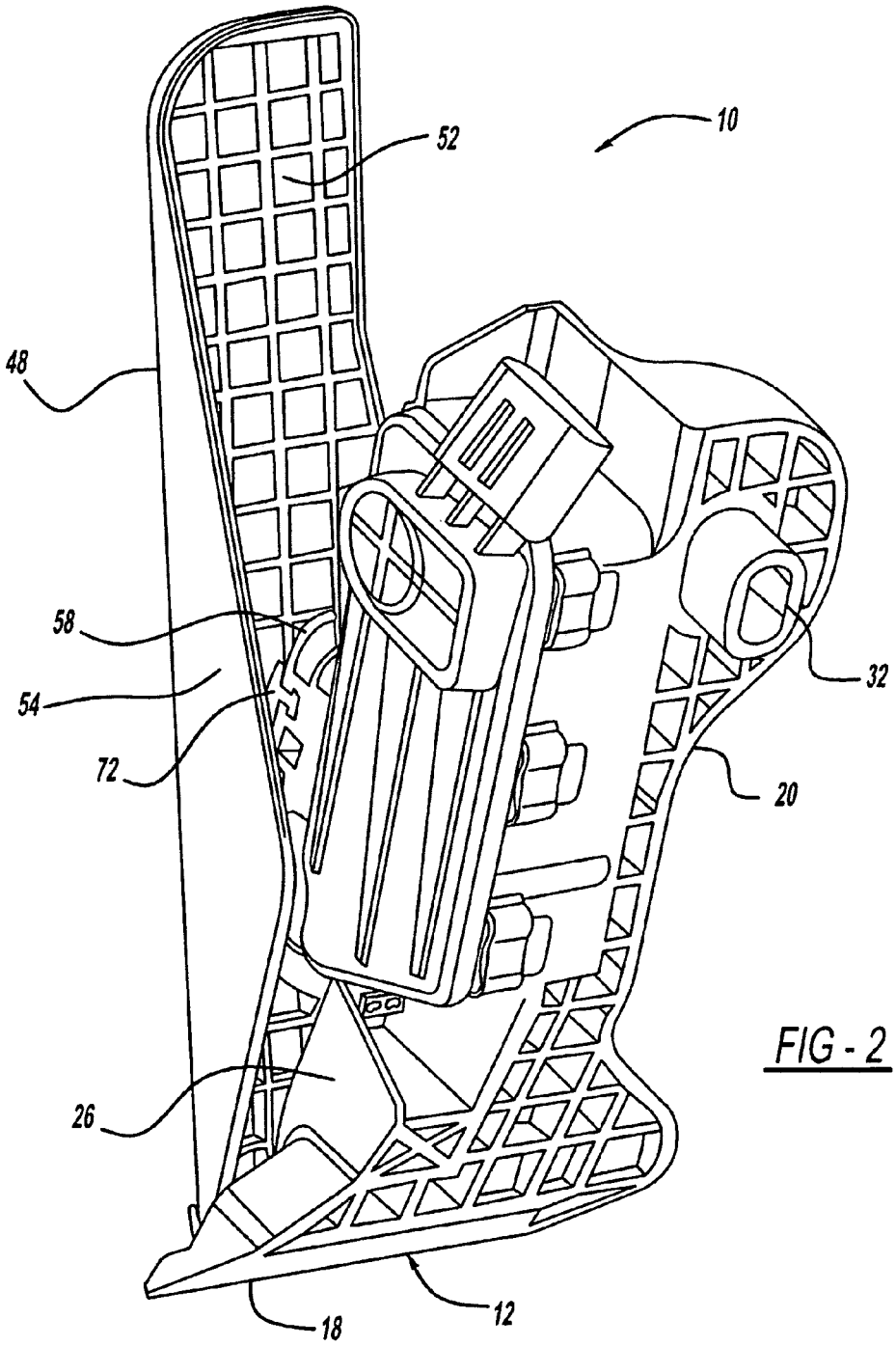
FIG. 2 is a perspective rear view of the pedal assembly of FIG. 1, according to the present invention.
Figure 3:
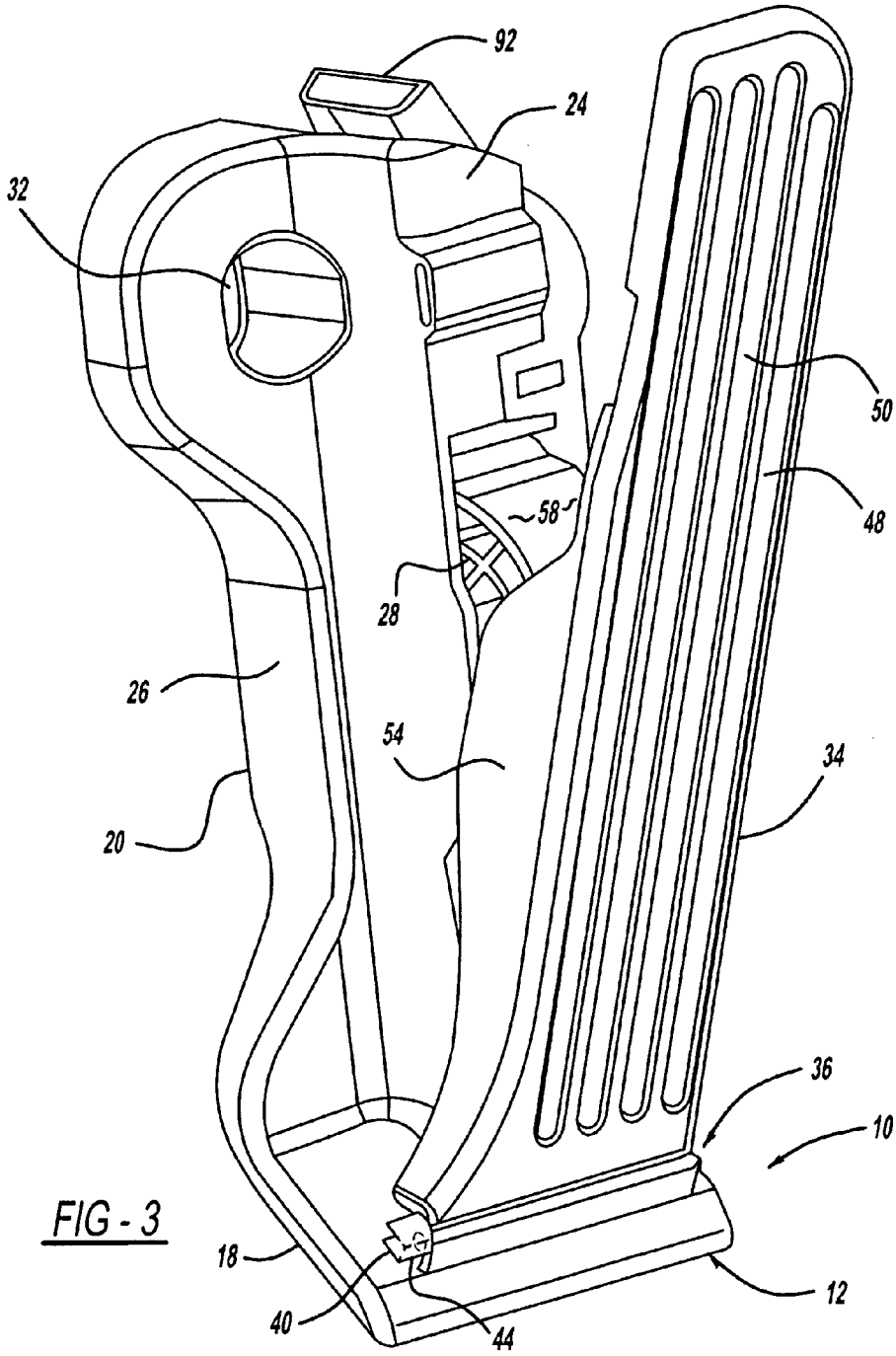
FIG. 3 is a perspective side view of the opposed side of the pedal assembly of FIG. 1, according to the present invention.

Referring to FIGS. 1-4, an electronically controlled floor mounted pedal assembly 10 is illustrated. It should be appreciated that in this example, the electronically controlled floor mounted pedal assembly 10 is a throttle pedal assembly for a vehicle, such as an automotive vehicle. The pedal could also have another use, such as a brake pedal or a clutch pedal. The floor mounted throttle control pedal assembly 10 of this example transmits a signal from the driver to a throttle controller (not shown) regarding movement of the vehicle.

The pedal assembly 10 includes a base member 12 that provides a support or attachment surface for the pedal assembly 10. For example, the base member 12 provides a support for the pedal arm, control arm or a sensor in a manner to be described. The shape of the base member 12 is selectively determined, and may correspond with the shape of the vehicle. The base member 12 is molded from a suitable material, such as a moldable composite material, a metal material, or the like. The base member 12 is fixedly secured to the vehicle. In this example, the base is mounted to a floor 14 of the vehicle, although it could be mounted to a wall 16, such as the fire wall, or a combination thereof.

The base member 12 includes a lower portion 18 that extends along the floor 14 of the vehicle, and an upper portion 20 that generally extends along the firewall portion 16 of the vehicle. The base member lower portion 18 is generally planar, and is fixedly secured to the vehicle using a connector.

For example, the base member lower portion 18 may include an aperture for receiving a fastener, such as a bolt, for securing the base member 12 to the vehicle. In another example, the base member lower portion 18 includes a tabbed portion not shown, such as a lug, that is press fit into a corresponding receptacle integrally formed in the floor 14 or wall 16 of the vehicle.

The base member upper portion 20 includes a front wall 24 and a side wall 26 extending from an edge of the front wall 24. The base member upper portion 20 may include two side walls 26. The front wall may be generally planar or have another shape. In this example, the front wall 24 forms an "L" shape. A portion of the front wall includes an opening 28 defining a cavity 30 for receiving a control member, in a manner to be described. In this example, the front wall cavity 30 is located adjacent a side wall 26 having a position sensor attached thereto. The position sensor module is mounted to one of the side walls 26, and may define one side of the cavity 30. The base member upper portion 20 may also be fixedly secured to the vehicle. For example, the base member front wall 24 may include an opening 32, which in this example is formed in the upper portion of the base member front wall 24 as for receiving a fastener such as a bolt. In another example, the base member upper portion 20 may include a tabbed portion such as a lug, that is press fit into a corresponding receptacle formed in the wall of the vehicle.

The pedal assembly 10 also includes a pedal arm 34 rotatably supported by an attaching portion of the base member, as shown at 36. The pedal arm 34 rotates about a pedal arm pivot axis 40 in order to actuate the vehicle. The pedal arm 34 includes a pedal pad 48 that is actuated by a driver's foot (not shown). An example of a rotatable support is a pivot pin 44 that is rotatably supported by the base member attaching portion 36. The pivot pin 44 may be integrally formed in the pedal arm 38, or a separate member for interconnecting the pedal arm 34 and base member 12. In an example of an integrally formed pivot pin, the lower end of the pedal arm 34 has a barrel-shaped portion which is adapted to be received in the base member attaching portion. The pivot pin 44 may be disposed within a pair of apertures located in the base member attaching portion 36. In another example, the pivot pin is received in a corresponding a groove in the base member attaching portion 36 for operatively receiving the pivot pin 44. Still another example of a rotatable support is a hinge. For example, the hinge may be an integrally formed living hinge interconnecting the pedal arm and base member. The living hinge may be a different material that either the pedal arm or the base member or the same material The pedal arm 34 includes an elongated planar pedal pad portion 48 having an outer surface 50 and an inner surface 52. The operator's foot is in contact with the pedal pad 50 outer surface in order to operate the vehicle. In this example, a pair of flanges 54 extend outwardly from an edge of the planar pedal pad portion 48. One of the flanges 54 is adjacent the side wall 26 of the base member upper portion 20. The opposed flange extends adjacent the sensor, and protects the sensor. A pedal pad inner surface 52 also includes a frictional wall portion 56 that provides a hysteresis effect in a manner to be described. The pedal pad friction wall 56 may be integrally formed in the pedal pad 48 or a separate member. The pedal pad friction wall 56 may be a suitable material for increasing friction between the pedal pad 48 and the control arm.

The pedal assembly 10 also includes a control arm 58 disposed between the base member 12 and the pedal arm 34. In this example, the control arm 58 has an s-shape, although other shapes are contemplated depending on the geometry of the pedal assembly 10. A first, free end of the control arm shown at 60, is positioned adjacent the pedal arm inner surface 52 and the control arm first free end 60 slides along the pedal pad inner surface 52 when the pedal pad 48 is depressed. The degree of rotation of the pedal pad 48 and concurrent rotation of the control arm 58, is detected by a position sensing device, which generates an electric signal indicative of the pedal's position in a manner to be described. A second opposed end of the control arm as shown at 62, is pivotally supported by the base member 12. For example, a connecting member 64, such as a post or a pivot pin or the like, operatively interconnects the control arm 58 and the base member 12. The connecting member 64 may be disposed within an aperture formed in a wall of the base member, such as the front wall 24 or the side wall 26. The connecting member 64 may include a longitudinally extending cavity for receiving a position sensing device, in a manner to be described.

The control arm 58 includes an outer wall, an inner wall, and side walls interconnecting the outer wall and inner walls. A portion of the control arm 58, which in this example is the outer wall of the free end, is in sliding contact with the pedal pad friction wall 56 as the pedal pad 42 is actuated, as shown at 70. The control arm contact portion 70 may include a friction member 72 that is in frictional contact with the pedal pad friction wall 56. The control arm friction member 72 may be integrally formed in the control arm, or a separate piece operatively connected to the control arm 58. Further, the location of the control arm friction member 72 is generally determinable based on factors such as the shape of the control arm 58, or the predetermined transmission shift points, or the like. The control arm friction member 72 may be a predetermined wall thickness and shape. The shape and dimensional characteristics of the control arm friction member 72 may influence the hysteresis or "feel" of the pedal as it is actuated by the operator, and these characteristics may be varied to achieve the desired hysteresis. For example, the frictional surface of the control arm friction member 72 may be abraded. In another example, the control arm friction member 72 is a friction pad or the like in order to provide additional resistance. The material for the control arm friction member 72 is selectively determined to have a predetermined coefficient of friction, to achieve the desired hysteresis feel. The control arm member 72 may be formed from a hard stable plastic, such as Teflon or the like. The interaction between the pedal pad friction wall 56 and control arm friction member 72 generates friction, to provide the hysteresis feel to the vehicle operator.

Figure 5:
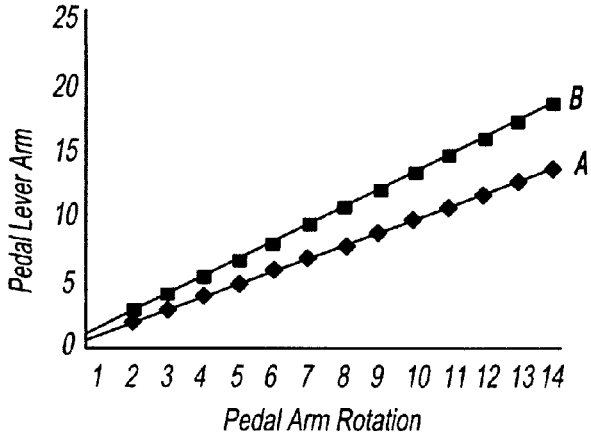
FIG. 5 is a graph illustrating the pedal arm rotation versus control arm rotation, according to the present invention.

The control arm friction member 72 may have a selectively determinable shape to maintain a predetermined relationship between the angle of depression of the pedal with the degree of angular rotation of the pedal position sensing device. For example, a radius of curvature of the control arm friction member 72 may be selected to achieve the predetermined relationship between the angle of pedal depression and pedal feel or "hysteresis". Examples of the relationship between the degree of pedal pad rotation and effective pedal lever arm B is illustrated in the chart of FIG. 5 at A and B.

Figure 4:
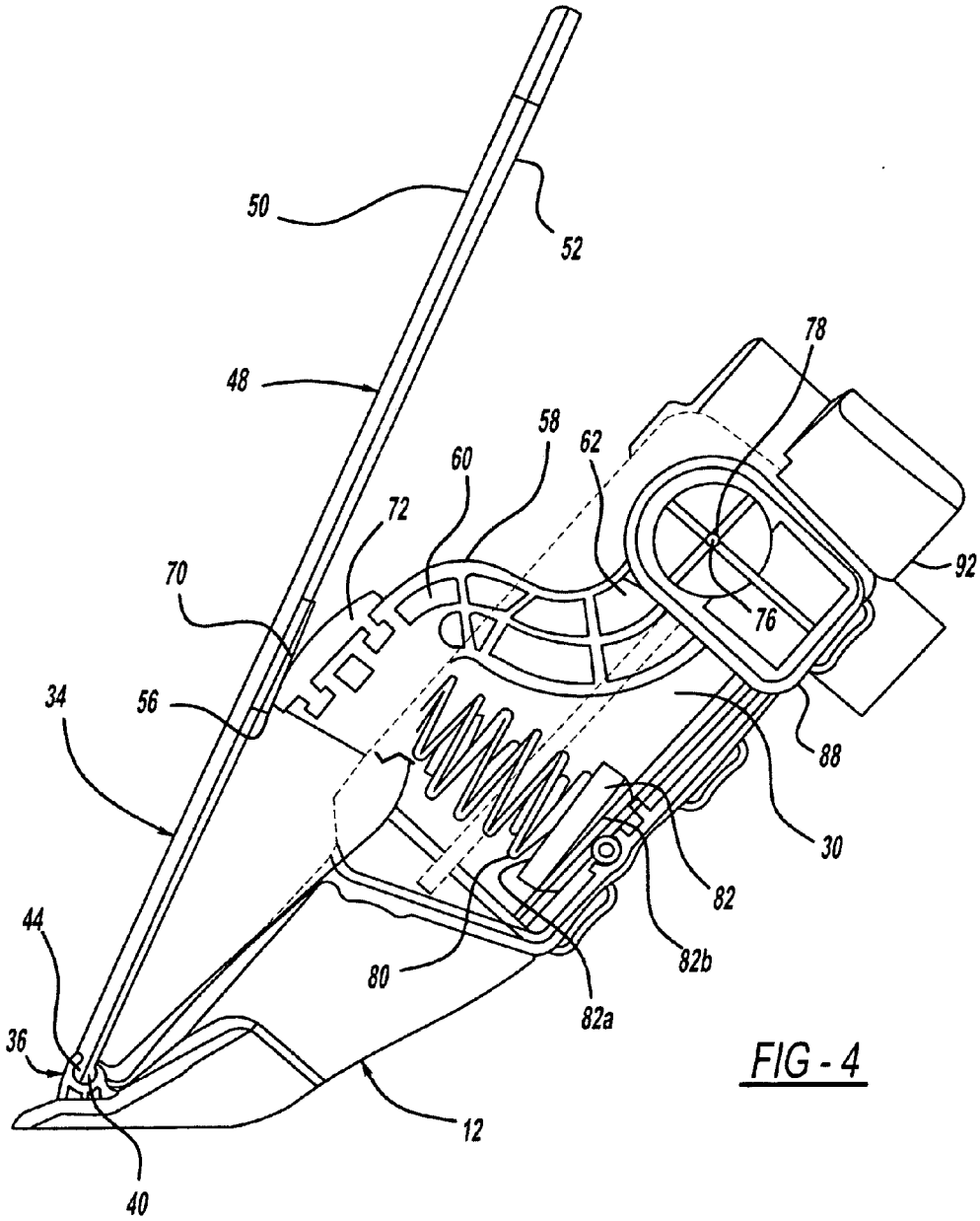
FIG. 4 is a partially cut-away side view of the pedal assembly of FIG. 1, according to the present invention.

As shown in FIG. 4, an example of a method for determining the shape of the control arm friction member 72 is illustrated. A point of contact shown at 70 between the friction member 72, and the pedal arm 48 is selected, and a line is drawn from the pedal arm pivot axis 40 to the contact point 70 and from the control arm pivot axis 76 to the same point. From the radial curves and resulting angles between the points, a spline curve is created which determines the shape of the control arm friction member 72. There is a one to one correspondence between the degrees of rotation of the pedal pad and the corresponding degrees of rotation of the control arm, and this angular rotation is transferred to the pedal position sensing device.

The pedal assembly 10 further includes a return spring 80 for initially biasing the position of the control arm 58 with respect to the pedal arm 34 and returning the control arm 58 and pedal arm 34 to an initial position after the actuating force is removed. In this example, the return spring 80 is a compression spring. One end of the return spring 80 is secured to the control arm 58, and a second end of the return spring 80 is attached to the base member 12. The pedal assembly 10 may include two concentric return springs 80 to provide redundancy in case one spring breaks. In operation, the return spring 80 is compressed between the pedal arm 34 and the control arm 58 as the pedal pad 48 is actuated, and the resulting spring force returns the pedal arm 34 to its initial position after the actuating force or the operator's foot, is removed from the pedal pad 48.

As shown in FIG. 4, a pair of return springs 80 are located within the base member cavity 30 and extend between the free, control arm first end 60 and the base member 12. The first end of the return spring 80 is operatively attached to the control arm first end 60. The second end of the return spring 80 is operatively secured to a return spring support 82, and the return spring support 82 is pivotally mounted to the base member 12. In this example, the return spring support 82 is a generally planar member having an upper surface 82a and a lower surface 82b. The return spring second end is secured to the return spring support upper surface 82a, and the return spring support lower surface 82b is secured to a wall 16 of the base member 12. In this example, the return spring 80 extends through the cavity 30 formed in the base member 12. The pivotal attachment of the return spring 80 permits the spring to maintain a predetermined alignment as the pedal pad 48 is actuated. The return spring 80 raises the pedal arm 34 back to an initial position when an actuating force on the pedal pad 48 is removed.

Figure 8:
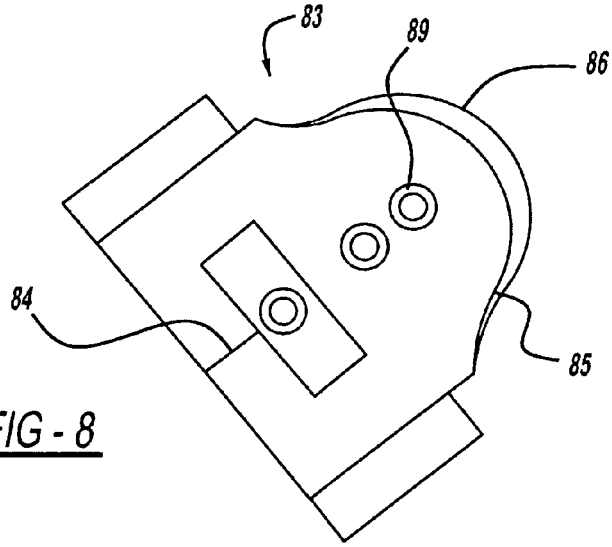
FIG. 8 is an enlarged view of the kickdown generating device of FIG. 6, according to the present invention.
Figure 6:
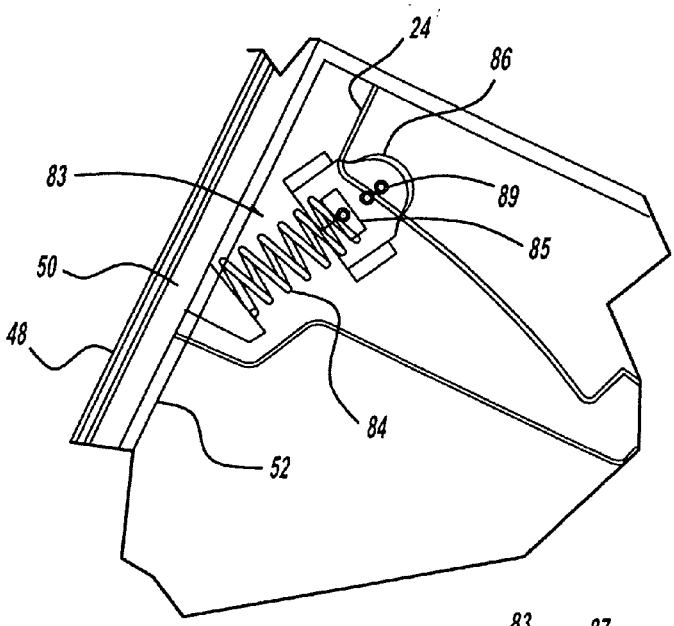
FIG. 6 is a side view of the pedal assembly of FIG. 1 with a kickdown generating device in an initial position, according to the present invention.
Figure 7:
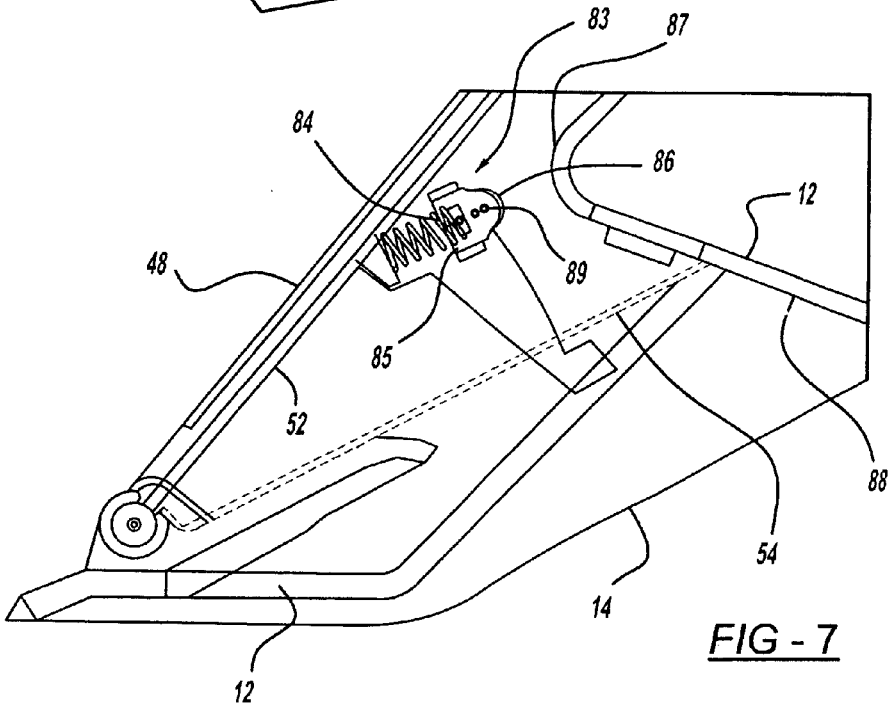
FIG. 7 is an enlarged view of the kickdown generating device in an engaged position, according to the present invention.

Referring to FIGS. 6-8, the pedal assembly 10 also includes a kickdown spring mechanism 83 located within a cavity 86 formed in the pedal pad 48. The kickdown mechanism 83 provides the operator with the feel of "kickdown", experienced when the vehicle transmission downshifts to a lower gear in response to depression of the pedal pad 48 by the operator to accelerate the vehicle. In this example, the kickdown mechanism 83 includes a roller member 85 fixedly disposed in the pedal pad cavity 86. For example, the roller member is disposed within the pedal pad cavity 86 in a press fit engagement or an interference fit or the like. In addition, a compression spring 84 having a first end adjacent the pedal pad inner surface 52, and a second end operatively attached to the roller member 85 is also disposed within the pedal pad cavity 86. The spring 84 initially positions the roller member 85 within the pedal pad cavity 86, as shown in FIG. 6. As the pedal pad 48 is depressed a predetermined angular amount, it engages a portion of the base member 12 as shown at 87. The engagement portion may have a geometric shape. At the same time, the kickdown roller moves about a guide 89 integrally formed in the pedal pad cavity in a downward direction, thus compressing the spring, as shown in FIG. 7. The engagement of the pedal pad and compression of the spring creates a kickdown force, since the spring and engagement of the pedal pad work against eachother. The kickdown force replicates the feeling of "kickdown" experienced with a vehicle having a mechanically controlled transmission. The degree of kickdown force is selectively determinable based on features such as spring force, geometric shape of the kickdown roller, shape of the base member engagement portion, distance of travel of kickdown roller or the like.

The electronically controlled pedal assembly 10 further includes a position sensing device 88 operatively supported on the base member 12 at the control arm pivot axis 76. The position sensing device may include a housing 90 secured to the base member 12. For example, the base member 12 may have an integrally formed receptacle, such as on the wall, to receive a corresponding attaching member integrally formed in housing 90 of the position sensing device 88.

The position sensing device 88 is used to sense the relative angular position of the pedal arm with respect to an initial starting position, via the corresponding rotational movement of the control arm 58. The position sensing device 88 transmits a signal indicative of the relative pedal position to a controller (not shown), and the controller uses the relative pedal position to operatively control a fuel delivery device (not shown) and thus the movement of the vehicle. In an example, the signal is a proportional voltage signal. It should be appreciated that the control arm pivot pin 78 operatively connecting the control arm 58 to the base member may be utilized to operatively transfer the rotational movement of the control arm to the position sensing device 88, to generate a signal indicative of the relative position of the pedal arm 34 during operation. For example, the pin 78 is received in a corresponding receiving portion of the position sensor 88. Alternatively, a portion of the position sensing device is received within a channel formed in the control arm pivot pin 78. The position sensing device includes sealed electronic unit 36 mounted to the base member. The position sensing device 88 communicates with the controller via a communication means. In this example, the position sensing device 88 includes a plug module 92 formed in the housing 90 for connecting to a wire (not shown), to deliver the signal from the position sensing device 88 to a controller (not shown), such as an electronic control unit or the like.

Various types of position sensing devices 88 are known in the art to sense rotational movement. One example of such a sensing device is a potentiometer. Another example of a sensing device is an induction sensor. The induction sensor utilizes inductance changes in a transducer circuit to produce an output signal representing the angular change in position of the pedal arm 34. Advantageously, the induction sensor works well in harsh environments or in environments subject to fluctuations in temperature. One example of an induction sensor utilizes a linear or a rotary variable differential transformer means, or a Hall effect detection of magnetic change, to convert a displacement or angular measurement to an electronic or electromagnetic signal. While these types of sensors work well, they require complex electronic circuitry to transduce a signal, and are expensive to manufacture. Another example of an induction sensor is disclosed in commonly assigned U.S. Pat. No. 6,384,596, the disclosure of which is incorporated herein by reference. An example of a housing cap assembly for use with an electronically controlled pedal assembly is disclosed in commonly assigned U.S. patent application Ser. No. 10/621,904, which is incorporated herein by reference. The induction sensor operatively senses the angular movement of the control arm 58 about the control arm pivot axis 76, and transmits a proportional signal, such as a voltage signal, to a controller. The controller analyzes the signal, and transmits a signal to actuate the throttle accordingly. Still another example of an induction sensor is manufactured by KSR International Inc. and is shown in commonly owned U.S. Pat. No. 7,191,759.

In operation, as the pedal pad 48 is depressed by the operator, the pedal arm 34 pivots about the pedal arm pivot axis 40. Contact between the pedal 34 and control arm, 58 induces a corresponding rotation of the control arm second end 62 about the control arm pivot axis 76. As the pedal arm 34 and control arm 58 rotate, the return spring 80 is compressed between the control arm 34 and the base member 12. At the same time, the control arm friction member 72 travels along the pedal pad friction wall 56 to provide a hysteresis effect to the operator. The degree of rotation of the control arm 58 about the control arm pivot axis 76 is sensed by the position sensing device 88 and a signal is transmitted to the controller, to control the operation of the vehicle. When the load on the pedal arm 34 is released, the pedal arm 34 returns back to it's initial position, and the control arm 58 returns back to its initial position, as a result of the return spring force. If the vehicle has an electronic transmission, the feeling of "kickdown" during an acceleration is replicated by the kickdown force generated by the compression of the kickdown spring 84 and engagement of the pedal pad with the base member, while accelerating.

It should also be appreciated that any of the above described pedal assemblies may include other components that are known in the art, such as an adjustable pedal height mechanism or electrical connectors, or the like.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

The invention claimed is:

1. An electronically controlled floor mounted pedal assembly with a position sensor comprising:

a base member fixedly attached to a vehicle floor and having a lower portion and an upper portion;

a control arm having a first free end and a second end pivotally mounted to the base member at a control arm pivot axis;

a pedal arm pivotally mounted to the base member at a pedal arm pivot axis, wherein the pedal arm includes an inner surface, and the control arm free end is positioned adjacent the inner surface of the pedal arm such that the control arm transfers an angular rotation of the pedal arm about the pedal arm pivot axis into an angular rotation of the control arm about the control arm pivot axis, a control arm friction member mounted on the control arm free end, such that the control arm friction member contacts a pedal arm friction member positioned on the inner surface of the pedal arm, to generate a frictional hysteresis force that is translated back through the pedal arm as the pedal arm is depressed, the frictional hysteresis force providing a hysteresis feel during pedal operation;

a return spring positioned between the base member and the control arm, wherein the return spring initially biases the control arm against the pedal arm; and a position sensor supported on the base member about the control arm pivot axis, wherein the position sensor is operatively connected to the control arm to sense angular rotation of the control arm about the control arm pivot axis as the pedal arm rotates about the pedal arm pivot axis, the control arm friction member being in sliding contact with the pedal arm friction member, the control arm friction member having a shape configured to achieve a linear relationship between the angular rotation of the pedal arm and the angular rotation of the control arm.

2. The pedal assembly of claim 1 wherein the base member upper portion includes a front wall and a side wall extending from an edge of the front wall, and the front wall includes an opening, and the control arm extends therethrough the opening in the base member front wall.

3. The pedal assembly of claim 1 wherein the control arm friction member is arcuate in shape.

4. The pedal assembly of claim 1 wherein a first end of the return spring is operatively attached to the control arm and a second end of the return spring is operatively attached to a spring support, and the spring support is pivotally attached to the base member.

5. The pedal assembly of claim 4 wherein the return spring extends therethrough an opening in a front wall of the base member.

6. The pedal assembly of claim 1 wherein a pivot pin pivotally connects the control arm to the base member at the control arm pivot axis, and the position sensor is operatively connected to the pivot pin.

7. The pedal assembly of claim 1, further comprising a kickdown mechanism disposed in a cavity in the pedal arm, wherein the kickdown mechanism includes a compression spring having an end secured to a kickdown roller member that is slidingly disposed in a pedal pad cavity, and rotation of the pedal arm initiates a corresponding movement of the kickdown roller within the pedal pad cavity to compress the kickdown spring and engagement of the pedal arm with an engagement surface of the base member, to generate a kickdown force that is transmitted to the pedal arm.

8. The pedal assembly of claim 1, both the control arm and the position sensor being located beneath the pedal arm, between the pedal arm and the base member.

9. An electronically controlled floor mounted pedal assembly with a position sensor comprising:

a base member fixedly attached to a floor of a vehicle and having a lower portion and an upper portion, wherein the upper portion includes a front wall and a side wall extending from an edge of the front wall, and the front wall includes an opening;

a control arm having a first free end and a second end pivotally mounted to the base member at a control arm pivot axis, wherein the control arm free end extends therethrough the opening in the base member front wall;

a pedal arm pivotally mounted to the base member at a pedal arm pivot axis, wherein the pedal arm includes a pedal pad having an inner surface, and the control arm free end is positioned adjacent the inner surface of the pedal pad such that the control arm transfers an angular rotation of the pedal pad about the pedal arm pivot axis into an angular rotation of the control arm about the control arm pivot axis, a control arm friction member mounted on the control arm free end, such that the control arm friction member contacts a pedal pad friction wall positioned on the pedal arm inner surface;

a return spring positioned between the base member and the control arm free end, wherein the return spring initially biases the control arm friction member against the pedal pad friction wall, such that rotation of the pedal arm by application of a load to the pedal arm compresses the return spring to generate a frictional hysteresis force that is translated back through the pedal arm, the frictional hysteresis force providing a hysteresis feel during pedal operation; and a position sensor supported on the base member about the control arm pivot axis, wherein the position sensor is operatively connected to the control arm to sense rotation of the control arm about the control arm pivot axis and translates the sensed rotational movement into a control signal indicating rotational movement of the pedal arm about the pedal arm pivot axis, the control arm friction member being in sliding contact with the pedal arm friction member, the control arm friction member having a shape configured to achieve a linear relationship between the angular rotation of the pedal arm and the angular rotation of the control arm.

10. The pedal assembly of claim 9 wherein the control arm friction member is abraded.

11. The pedal assembly of claim 9 wherein the control arm friction member is arcuate in shape.

12. The pedal assembly of claim 9 wherein a first end of the return spring is operatively attached to the control arm and a second end of the return spring is operatively attached to a spring support, and the spring support is pivotally attached to the base member.

13. The pedal assembly of claim 9 wherein the return spring extends therethrough the opening in the front wall of the base member.

14. The pedal assembly of claim 9 wherein a pivot pin pivotally connects the control arm to the base member at the control arm pivot axis, and the position sensor is operatively connected to the pivot pin.

15. The pedal assembly of claim 9, further comprising a kickdown mechanism disposed in a cavity in the pedal arm, wherein the kickdown mechanism includes a compression spring having an end secured to a kickdown roller member that is slidingly disposed in the pedal pad cavity, and rotation of the pedal arm initiates a corresponding movement of the kickdown roller within the pedal pad cavity to compress the kickdown spring and engagement of the pedal arm with an engagement surface of the base member, to generate a kickdown force that is transmitted to the pedal arm.

16. An electronically controlled floor mounted pedal assembly with a position sensor comprising:

a base member fixedly attached to a vehicle floor and having a lower portion and an upper portion, wherein the upper portion includes a front wall and a side wall extending from an edge of the front wall, and the front wall includes an opening;

a control arm having a first free end and a second end pivotally mounted to the base member at a control arm pivot axis, wherein the control arm free end extends therethrough the opening in the base member front wall;

a pedal arm pivotally mounted to the base member at a pedal arm pivot axis, wherein the pedal arm includes a pedal pad having an inner surface, and the control arm free end is positioned adjacent the pedal pad inner surface and the control arm extends therethrough the opening in the base member front wall such that the control arm transfers an angular rotation of the pedal arm about the pedal arm pivot axis into an angular rotation of the control arm about the control arm pivot axis;

a control arm friction member mounted on the control arm free end, such that the control arm friction member contacts a pedal arm friction member positioned on the pedal pad inner surface;

a return spring positioned between the base member and the control arm free end, wherein the return spring initially biases the control arm friction member against the pedal pad friction wall, such that rotation of the pedal arm by application of a load to the pedal arm compresses the return spring to generate a frictional hysteresis force that is translated back through the pedal arm;

a pivot pin, pivotally connecting the control arm to the base member; and a position sensor supported on the base member about the control arm pivot axis, the position sensor being operatively connected to the pivot pin, wherein the position sensor senses rotational movement of the control arm about the control arm pivot axis and translates the sensed rotational movement into a control signal indicating rotational movement of the pedal arm about the pedal arm pivot axis, the control arm friction member having a shape configured to achieve a linear relationship between the angular rotation of the pedal arm and the angular rotation of the control arm, the control arm friction member being in sliding contact with the pedal arm friction member, the control arm friction member being further configured so that the frictional hysteresis force provides a desired pedal feel to a vehicle operator during pedal operation.

17. The pedal assembly of claim 16 wherein the control arm friction member is arcuate in shape.

18. The pedal assembly of claim 16 wherein the first end of the return spring is operatively attached to the control arm and a second end of the spring is operatively attached to a spring support, and the spring support is pivotally attached to the base member.

19. The pedal assembly of claim 16 wherein the return spring extends therethrough the opening in the front wall of the base member.

20. The pedal assembly of claim 16, further comprising a kickdown mechanism disposed in a cavity in the pedal arm, wherein the kickdown mechanism includes a compression spring having an end secured to a kickdown roller member that is slidingly disposed in the pedal pad cavity, and rotation of the pedal arm initiates a corresponding movement of the kickdown roller within the pedal pad cavity to compress the kickdown spring and engagement of the pedal arm with an engagement surface of the base member, to generate a kickdown force that is transmitted to the pedal arm.

* * * * *